US006886480B2

(12) United States Patent
Serrano

(10) Patent No.: US 6,886,480 B2
(45) Date of Patent: May 3, 2005

(54) METHOD OF CONSTRUCTING A POCKET ON A GARMENT AND A METHOD OF EMBROIDERING A POCKET ON A GARMENT

(75) Inventor: Francisco Joaquin Serrano, Worcester (GB)

(73) Assignee: Badger Limited (GB)

( * ) Notice: Subject to any disclaimer, the term of this patent is extended or adjusted under 35 U.S.C. 154(b) by 208 days.

(21) Appl. No.: 10/407,725

(22) Filed: Apr. 4, 2003

(65) Prior Publication Data

US 2004/0221785 A1 Nov. 11, 2004

(51) Int. Cl.[7] ..... D05B 3/12; A41D 27/08; A41D 27/20

(52) U.S. Cl. ..... 112/475.09; 112/475.18; 2/246; 2/247

(58) Field of Search ..... 112/475.09, 470.14, 112/475.18, 475.21, 103; 2/246, 247, 248, 251, 252, 254

(56) References Cited

U.S. PATENT DOCUMENTS

| | | | | | |
|---|---|---|---|---|---|
| 2,389,721 | A | * | 11/1945 | Durso | 2/247 |
| 2,519,126 | A | * | 8/1950 | Falk | 2/247 |
| 2,530,453 | A | * | 11/1950 | Eagle | 2/247 |
| 2,919,443 | A | * | 1/1960 | Kashiyama | 2/94 |
| 3,564,615 | A | * | 2/1971 | Jacobson | 2/247 |
| 4,969,214 | A | * | 11/1990 | Cohen | 2/94 |
| 5,720,050 | A | * | 2/1998 | Gioli | 2/247 |
| 5,823,128 | A | * | 10/1998 | Lapidus | 112/475.06 |
| 5,832,540 | A | * | 11/1998 | Knight | 2/247 |
| 6,175,966 | B1 | | 1/2001 | Wiesenthal | 2/247 |
| 6,199,210 | B1 | * | 3/2001 | Feldman | 2/69 |
| 6,298,800 | B1 | * | 10/2001 | Gala | 112/103 |
| 6,769,139 | B1 | * | 8/2004 | Goldkind | 2/247 |
| 2002/0148397 | A1 | * | 10/2002 | Vickroy | |

FOREIGN PATENT DOCUMENTS

| | | |
|---|---|---|
| CA | 2244701 | 11/1999 |
| GB | 291268 | 5/1928 |
| GB | 470124 | 8/1937 |
| GB | 2377878 B | 1/2003 |
| JP | 020293460 | 12/1990 |
| JP | 090013205 | 1/1997 |

* cited by examiner

*Primary Examiner*—Ismael Izaguirre
(74) *Attorney, Agent, or Firm*—MacMillan, Sobanski & Todd, LLC

(57) ABSTRACT

A method of constructing a patch pocket on a garment. A flap is initially cut in the outer surface of the garment at the desired pocket location. Preferably, the flap is generally U-shaped. A pocket lining is attached to the flap and together the flap and pocket lining define a pouch which will form the interior of the pocket. A pocket covering is attached to a portion of the pocket lining and to the garment in a manner which permits the pouch to be displaced from behind the pocket covering to facilitate embroidering the pocket covering when in place on the garment.

16 Claims, 3 Drawing Sheets

METHOD OF CONSTRUCTING A POCKET ON A GARMENT AND A METHOD OF EMBROIDERING A POCKET ON A GARMENT

CROSS-REFERENCE TO RELATED APPLICATIONS

Not Applicable.

STATEMENT REGARDING FEDERALLY SPONSORED RESEARCH OR DEVELOPMENT

Not Applicable.

TECHNICAL FIELD

The invention relates to a method for constructing a pocket on a garment and, more particularly, but not exclusively to constructing a pocket on a school blazer so that the pocket can be embroidered once the pocket is in place on the blazer.

BACKGROUND OF THE INVENTION

Blazers are commonly used as part of a uniform for a pupil attending school and generally have the logo or emblem of the school embroidered onto the front chest pocket of the blazer.

Some blazers are manufactured in the country of the school for which they are to be used as part of the uniform, in which case the logo or emblem of the school can be embroidered onto the front chest pocket prior to, or during the construction of the blazer. However, to reduce the cost of the blazers it may be desirable to commission the manufacture of the blazers in a different country to that of where they are to be worn as part of a school uniform (e.g. manufactured in the Far East for distribution in the United Kingdom). These blazers are much cheaper, but normally have to be ordered up to twelve months in advance and as a result, it is not feasible to have the logo or emblem of the school embroidered on the pocket prior to, or during the construction of the blazer.

In the prior art there are three main methods of displaying the logo or emblem of the school on the blazer after the construction of the blazer. These are to:

1) attach a badge to the pocket (the logo or emblem being embroidered onto the badge), which is not as aesthetically pleasing as an embroidered pocket;
2) unstitch the pocket from the blazer, embroider the logo or emblem on to the pocket and then restitch the pocket back onto the blazer, however this also requires greater labor costs as the lining of the blazer has to be unstitched, so that the pocket can be reattached to the blazer; or
3) embroider the pocket through all layers of the pocket—resulting in an artificial, unusable pocket.

All of these methods are more time consuming than having the logo or emblem embroidered onto the pocket prior to, or during the construction of the blazer and hence result in a more expensive and generally less aesthetically pleasing embroidered pocket.

BRIEF SUMMARY OF THE INVENTION

According a first aspect of the invention there is provided a method of constructing a pocket on a garment, the method comprising the steps of: creating a first opening in the garment where the pocket is to be provided, said first opening creating a flap in the garment which is able to move in and out of the plane of the garment; attaching a pocket lining to the flap such that the flap and the pocket lining provide opposing internal surfaces of a pouch which is able to move in and out of the plane of the garment; and attaching a pocket covering to a portion of the pocket lining and to the garment to provide a surface able to be embroidered, wherein the pouch is able to be displaced from behind the pocket covering so that the pocket covering can be embroidered when in place on the garment.

The method provides the advantage that the covering of the pocket can be embroidered after the construction of the garment, thereby decreasing the total cost of the garment with an embroidered pocket. Preferably the method comprises the step of creating a second opening in the garment, between an outer section of the garment and a lining inside the garment. Conveniently the second opening has a zip fastener, allowing for the second opening to be opened and closed efficiently.

According to a second aspect of the invention there is provided a method of embroidering a covering of a pocket on a garment comprising the steps of: displacing a pouch portion of a pocket from behind a covering of the pocket, said pouch comprising a pocket lining and a flap of the garment, which are attached to each other to provide opposing internal surfaces of the pouch; introducing a support member through an opening in the garment, to support the covering of the pocket; holding the covering of the pocket in place against the support member by a frame member, thereby limiting the movement of the covering of the pocket during the embroidery process; and embroidering a logo or emblem onto the covering of the pocket.

The lining of the pocket being withdrawn from behind the covering of the covering of the pocket allows the covering of the pocket to be embroidered without embroidering through the lining and the flap. The support member may be an embroidery mandrel. The frame member may be an embroidery frame. When the logo or emblem has been embroidered onto the covering of the pocket the support member and frame member are removed from the garment and the second opening is closed.

It is therefore the object of the present invention to provide a method of constructing a pocket on a garment, which overcomes the aforementioned problems, so that the pocket can be embroidered with minimal disruption to the blazer and minimal labor costs.

Other objects and advantages of the invention will become apparent from the following detailed description of the invention and the accompanying drawings.

DETAILED DESCRIPTION OF THE INVENTION

Figure 1:
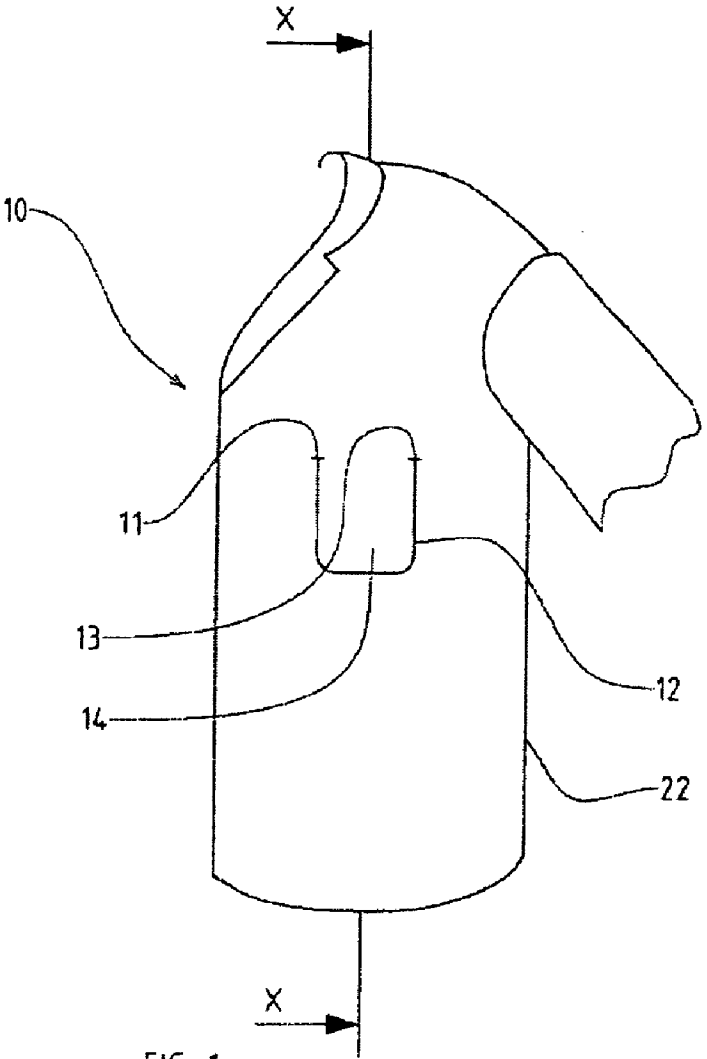
FIG. 1 is a front view of the left hand side of a blazer cut from a material, part way through its construction, having a U-shaped cut in the material, thereby providing a flap of material.

Referring to FIG. 1 there is shown the left hand side of a garment, in this case a blazer 10, part way through its construction. During the cutting of a fabric to make an outer section 22 of the blazer 10, a U-shaped cut 12 is made in the left hand chest section of the blazer from 11 to 13. The cut 12 provides a U-shaped flap of fabric 14.

Figure 2:
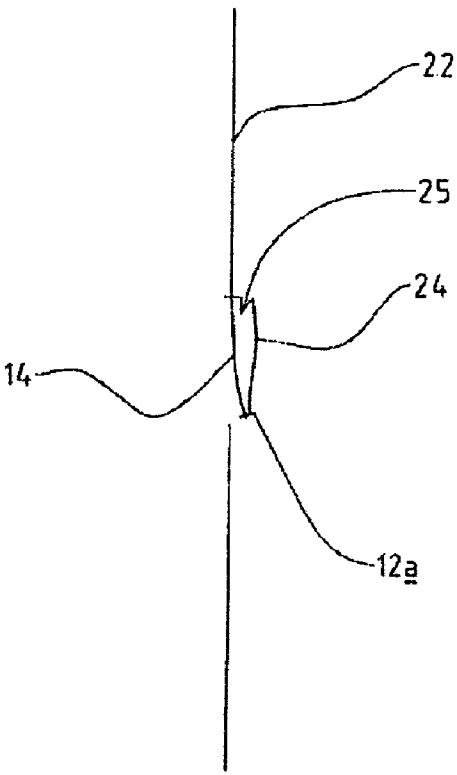
FIG. 2 is a cross-sectional view of FIG. 1 through X—X in a subsequent phase of manufacture, with a pocket lining being attached to the flap.

Referring to FIG. 2 there is shown a cross-sectional view of FIG. 1 through X—X in a subsequent phase of manufacture. A pocket lining 24 is attached to the flap 14 by stitching along the periphery 12*a* of the flap 14 and forms a U-shaped pouch with an opening shown generally at 25. The U-shaped pouch is able to be inverted about a line between the points 11 and 13 from its original position below the line to a second position above the line.

Figure 3:
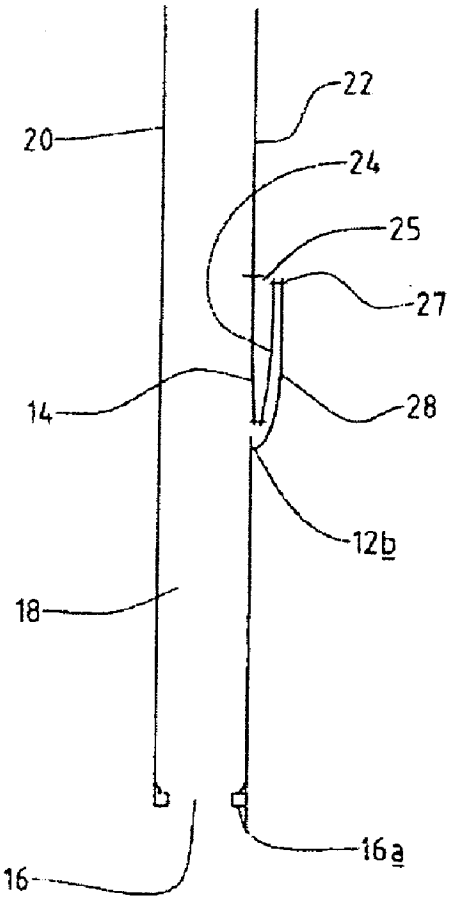
FIG. 3 is a further cross-sectional view through X—X in yet a further phase of manufacture, where a covering for the pocket lining is attached to the blazer and the pocket lining, and the blazer is conventionally lined with a blazer lining.

FIG. 3 is yet a further phase of the construction of the blazer 10 wherein a covering 28 for the pocket, slightly larger than the flap 14, is attached to the outer section 22 by stitching around the periphery 12*b* of the cut 12 and to the top 27 of the pocket lining 24. The order of construction of the pocket may be altered so that the lining 24 is attached to the covering 28 prior to the lining 24 and the covering 28 being attached to the flap 14 and the outer section 22 respectively, thereby providing the same configuration of pocket on the blazer 10 as previously described. The blazer 10 is then lined in the conventional manner with a blazer lining 20, attached to the outer section 22. An opening 16 is provided in the bottom of the left hand side of the blazer 10, substantially beneath the flap 14, between the blazer lining 20 and the outer section 22. The opening 16 can be closed by a zip fastener 16*a*, thereby providing efficient access to an interior 18 between the blazer lining 20 and the outer section 22.

Figure 4:
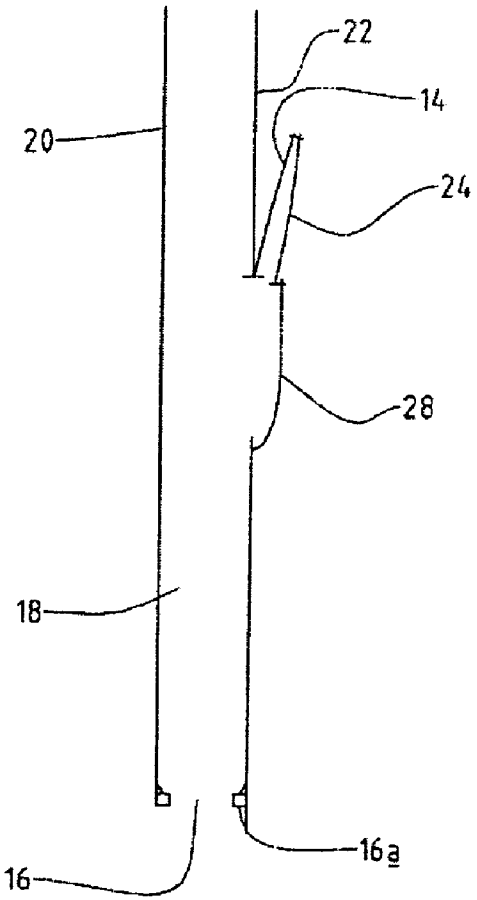
FIG. 4 is view of FIG. 3, with the pocket lining and the flap withdrawn from behind the covering of the pocket to allow the pocket to be embroidered.

FIG. 4 is a view of FIG. 3, wherein the pouch formed by the flap 14 and the pocket lining 24 are withdrawn from behind the covering 28 through the opening 25 to it's second position, so that the internal side of the covering 28 can be accessed from the interior 18 through the opening 16.

Figure 5:
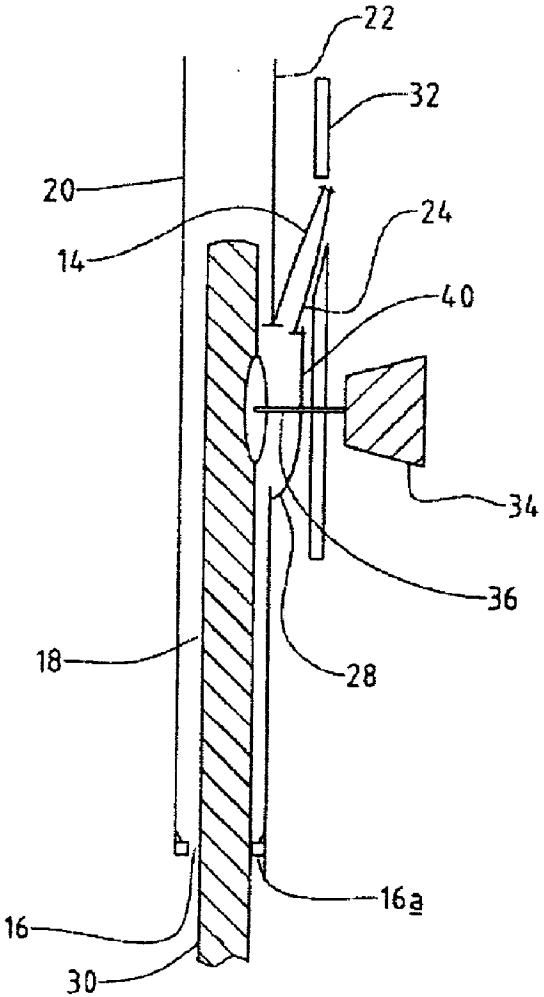
FIG. 5 is a diagrammatic view of an embroidery mandrel in place behind the pocket, embroidering a logo or emblem onto the pocket.

FIG. 5 is a diagrammatic view of an embroidery mandrel 30 in place in the interior 18 behind the covering 28. The mandrel 30 is inserted through the opening 16 into the interior 18 and behind the covering 28, so that the covering 28 can be embroidered. Placed on the outside of the covering 28 is an embroidery frame 32, which holds the covering 28 against the mandrel 30 to stop the covering 28 from moving during the embroidery process. A logo or emblem 40 is embroidered onto the covering 28 by an embroidery needle 36, which is controlled by an embroidery head 34. The head 34 is connected to an embroidery machine (not shown), which provides for the movement of the needle 36 and head 34. Once the logo or emblem 40 has been embroidered onto the covering 28 the needle 36 and head 34 are withdrawn from the covering 28. The frame 32 is then removed and the mandrel 30 is extracted from the interior 18 through the opening 16 and the zip fastener 16*a* closes the opening 16. The final stage of the process is to reinsert the pocket lining 24 and the flap 14 in behind the covering 28, thereby providing an embroidered pocket.

Figure 6:
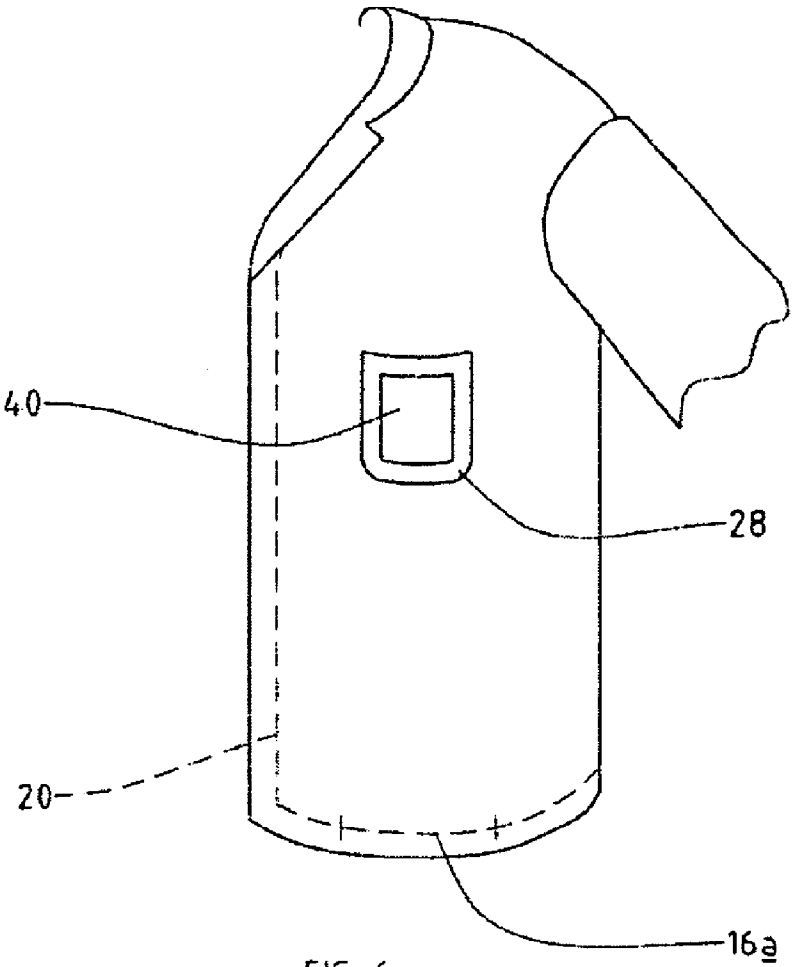
FIG. 6 is a front view of the left hand side of the blazer with the logo or emblem on the pocket.

Referring to FIG. 6 there is shown a front view of the left hand side of the blazer 10 with the logo or emblem 40 on the covering 28.

Although the invention has been described as having a second opening able to be closed by a zip fastener, the second opening may be closed by other fasteners, such as hook and loop fasteners such as Velcro or the like, studs or hook and eye fasteners. Equally the second opening may be closed by sewing the lining to the outer section of the garment. In addition the garment may be unlined and thus there will be no second opening.

The invention is described in relation to a blazer 10 but the invention may equally be applied to any other garment in which a patch type pocket is incorporated.

In the present specification "comprises" means "includes or consists of" and "comprising" means "including or consisting of".

It will be appreciated that various modifications and changes may be made to the above described preferred embodiment of a method of constructing a pocket on a garment without departing from the scope of the following claims.

What is claimed is:

1. A method of constructing a pocket on a garment, the method comprising the steps of:

creating a first opening in the garment where the pocket is to be provided, said first opening creating a flap in the garment which is able to move in and out of the plane of the garment;

attaching a pocket lining to the flap such that the flap and the pocket lining provide opposing internal surfaces of a pouch which is able to move in and out of the plane of the garment; and attaching a pocket covering to a portion of the pocket lining and to the garment to provide a surface able to be embroidered, wherein the pouch is able to be displaced from behind the pocket covering so that the pocket covering can be embroidered when in place on the garment.

2. A method according to claim 1 wherein the pocket covering and the flap are both U-shaped and provide a U-shaped pouch.

3. A method according to claim 1 comprising the step of creating a second opening in the garment between an outer section of the garment and a lining inside the garment.

4. A method according to claim 3 wherein the second opening has a zip fastener.

5. A method of embroidering a covering of a pocket on a garment comprising the steps of:

displacing a pouch portion of a pocket from behind a covering of the pocket, said pouch comprising a pocket lining and a flap of the garment, which are attached to each other to provide opposing internal surfaces of the pouch;

introducing a support member through an opening in the garment, to support the covering of the pocket;

holding the covering of the pocket in place against the support member by a frame member, thereby limiting the movement of the covering of the pocket during the embroidery process; and embroidering a logo or emblem onto the covering of the pocket.

6. A method according to claim 5 wherein the pocket lining and the flap are both U-shaped and provide a U-shaped pouch.

7. A method of embroidering a pocket on a garment according to claim 5 wherein the support member is an embroidery mandrel.

8. A method of embroidering a pocket on a garment according to claim 5 wherein the frame member is an embroidery frame.

9. A method of embroidering a pocket on a garment according to claim 5 wherein after the logo or emblem has been embroidered onto the covering of the pocket the support member and frame member are removed from the garment and the second opening is closed.

10. A pocket on a garment constructed according to a method comprising the steps of:

creating a first opening in the garment where the pocket is to be provided, said first opening creating a flap in the garment which is able to move in and out of the plane of the garment;

attaching a pocket lining to the flap such that the flap and the pocket lining provide opposing internal surfaces of a pouch which is able to move in and out of the plane of the garment; and attaching a pocket covering to a portion of the pocket lining and to the garment to provide a surface able to be embroidered, wherein the pouch is able to be displaced from behind the pocket covering so that the pocket covering can be embroidered when in place on the garment.

11. A garment having a pocket member attached to the outer surface of an outer layer of garment material, said outer layer having a cut formed therein, said pocket member having an edge forming an end of a pocket, a lining member having a first end edge connected with said pocket member adjacent said pocket member edge and having a second end edge attached to said outer layer adjacent said cut.

12. A garment according to claim 11, and wherein said pocket member edge forms a lower end of a pocket.

13. A garment according to claim 11, and wherein said cut in said outer layer is U-shaped forming a flap having sides and an end, and wherein said lining member is also attached to said flap along said sides of said flap.

14. A garment according to claim 13, and wherein the shape of said cut follows an outline of the connection of said pocket member to said outer layer.

15. A garment according to claim 11, and further including a lining layer provided at an inner side of said outer layer, and an opening between said outer layer and said lining layer of a size to provide access between said outer layer and said lining layer for a support member of an embroidery machine.

16. A garment according to claim 11, and wherein said pocket member is embroidered.

* * * * *